United States Patent [19]

Clauss et al.

[11] Patent Number: 4,898,680

[45] **Date of Patent: * Feb. 6, 1990**

[54] DETERGENT COMPATIBLE, DRYER RELEASED FABRIC SOFTENING/ANTISTATIC AGENTS

[75] Inventors: Allen D. Clauss; Gayle E. Culver; David M. Piatt; Thomas J. Wierenga, all of Cincinnati, Ohio

[73] Assignee: The Proctor & Gamble Company, Cincinnati, Ohio

[ * ] Notice: The portion of the term of this patent subsequent to May 9, 2006 has been disclaimed.

[21] Appl. No.: 270,402

[22] Filed: Nov. 7, 1988

Related U.S. Application Data

[63] Continuation of Ser. No. 58,449, Jun. 5, 1987, abandoned, which is a continuation-in-part of Ser. No. 933,824, Nov. 24, 1986, Pat. No. 4,828,746.

[51] Int. Cl.[4] ..... C11D 3/30; D06M 13/46

[52] U.S. Cl. ..... 252/8.8; 252/8.6; 252/8.9; 252/174.13; 252/174.17; 252/528; 252/547; 252/DIG. 3

[58] Field of Search ..... 252/8.6, 8.9, 174.13, 252/174.17, 528, 547, DIG. 3

[56] References Cited

U.S. PATENT DOCUMENTS

| | | | |
|---|---|---|---|
| 3,697,437 | 10/1972 | Fogle et al. | 264/4 |
| 3,896,033 | 7/1975 | Grimm, III | 252/8.8 |
| 3,936,537 | 2/1976 | Baskerville, Jr. et al. | 427/242 |
| 4,048,433 | 9/1977 | Burns et al. | 252/174.17 |
| 4,082,678 | 4/1978 | Pracht et al. | 252/8.6 |
| 4,095,946 | 6/1978 | Jones et al. | 8/137 |
| 4,141,841 | 2/1979 | McDanald | 252/8.8 |
| 4,234,627 | 11/1980 | Schilling | 427/242 |
| 4,250,043 | 2/1981 | Jones | 252/8.6 |
| 4,272,386 | 6/1981 | Draper, Jr. et al. | 252/8.6 |
| 4,566,993 | 1/1986 | Seiemski et al. | 252/174.17 |
| 4,828,746 | 5/1989 | Clauss et al. | 252/90 |

FOREIGN PATENT DOCUMENTS

| | | |
|---|---|---|
| 1425177 | 2/1976 | United Kingdom . |
| 1549432 | 8/1979 | United Kingdom . |

*Primary Examiner*—A. Lionel Clingman
*Assistant Examiner*—Linda D. Skaling
*Attorney, Agent, or Firm*—Robert B. Aylor; Richard C. Witte

[57] ABSTRACT

Fabric softener particles comprising an inner core of fabric softening composition and an outer coating completely surrounding said core. The outer coating is substantially water-insoluble and protects the inner core from dissolving when present in a typical fabric laundering operation, but releases the softener composition to the fabrics when the fabrics are dried in a heated dryer.

11 Claims, No Drawings

DETERGENT COMPATIBLE, DRYER RELEASED FABRIC SOFTENING/ANTISTATIC AGENTS

This is a continuation of application Ser. No. 058,449, filed June 5, 1987, which is a continuation-in-part of application Ser. No. 933,824, filed Nov. 24, 1986 now U.S. Pat. No. 4,828,746.

FIELD OF THE INVENTION

The invention pertains to coated particles of fabric softener which are included with detergent in the washing of fabrics. The particles survive the wash and release softener to the fabrics in a heated laundry dryer.

BACKGROUND OF THE INVENTION

The advantages obtained from the application of fabric conditioning agents (i.e., fabric softeners and/or antistatic agents) to laundered fabrics is well-known. The present invention pertains to coated particulate softener/antistatic compositions which survive the wash process and release the active softening/antistatic agent to the laundered fabrics in the dryer.

Fabric softening and antistatic benefits are a desirable part of the laundry process. Softening and antistatic compounds are, in general, quaternary ammonium compounds that are not compatible with anionic surfactants. These compounds will be referred to hereinafter as fabric softening compounds or fabric softeners, although it is to be understood that they deliver both softening and antistatic benefits to fabrics. The opposite electrical charge of the anionic surfactant used in most detergents and the quaternary ammonium fabric softening compounds leads to a mutual attraction which causes precipitation. This, in effect, removes surfactant and fabric softener from solution and reduces the cleaning capacity of the detergent while preventing effective fabric softener deposition on the fabric.

One solution to this incompatibility problem is the separate addition of the fabric softener during either the rinse cycle of the wash or while the fabrics are in the dryer. This increases the inconvenience of using fabric softeners because of the need to add them at a point in the laundering process which is different from that at which the detergent is added.

Various other solutions for this problem of incompatibility between detergent and softening compounds have been proposed in the art. U.S. Pat. No. 3,936,537, Baskerville Jr., issued Feb. 3, 1976, and U.S. Pat. No. 4,095,946, Jones, issued June 20, 1978, teach the use of intimate mixtures of organic dispersion inhibitors (e.g., stearyl alcohol and fatty sorbitan esters) with solid fabric softener to improve the survival of the softener in the presence of detergent in the washer so the softener can act on the fabrics when it melts in the dryer. U.S. Pat. No. 4,234,627, Schilling, issued Nov. 18, 1980, teaches microencapsulation of fabric softener. The microcapsules survive the wash and adhere to the fabric surface. They are then ruptured by subsequent tumbling of the fabric in the dryer, thereby releasing softener to the fabrics. In spite of these developments, there is a continuing need for methods and compositions which are suitable for conveniently and effectively delivering fabric softeners to fabrics during the home laundering process.

Accordingly, it is the object of the present invention to provide coated fabric softener compositions wherein the coating will be insoluble in a detergent solution but will release the softener to the fabrics at dryer temperatures.

SUMMARY OF THE INVENTION

The present invention is directed to detergent-compatible, dryer-activated fabric softening particles having diameters of from about 5 microns to about 1,200 microns comprising an inner core of a fabric softener composition comprising a cationic fabric softener compound, and an outer coating comprised of water-insoluble material having a melting point above about 35° C.

The particles can be incorporated into laundry detergents.

DETAILED DESCRIPTION OF THE INVENTION

The present invention relates to coated fabric softener particles which can be added to the wash step of the fabric laundering process and which release softener to fabrics in a laundry dryer. The invention also relates to laundry detergent compositions containing said particles.

A. The Particles

The particles of the present invention comprise an inner core of a fabric softener composition which comprises a cationic fabric softener, and an outer coating which completely surrounds the core and comprises a substantially water-insoluble material having a melting point above 35° C., preferably above 50° C. By "substantially water-insoluble" herein is meant having a solubility in 35° C. water of less than about 50 ppm. The particles have diameters of from about 5 microns to about 1,200 microns, preferably greater than about 500 microns, and most preferably greater than about 600 microns, with a number average of from about 900 to about 1,000 microns. The particles typically will be of a generally spherical shape, but can also have an irregular shape. The particle sizes quoted herein refer to the largest dimension (diameter or length) of the particle.

Typical cationic fabric softeners useful herein are quaternary ammonium salts of the formula $$[R_1R_2R_3R_4N]^+Y^-$$

wherein one or two of $R_1$, $R_2$, $R_3$ and $R_4$ groups is an organic radical containing a group selected from a $C_{12}$–$C_{22}$ aliphatic radical or an alkylphenyl or alkylbenzyl radical having from 10 to 16 carbon atoms in the alkyl chain, the remaining groups being selected from $C_1$–$C_4$ alkyl, $C_2$–$C_4$ hydroxyalkyl and cyclic structures in which the nitrogen atom in the above formula forms part of the ring, and Y constitutes an anionic radical such as halide, nitrate, bisulfate, methylsulfate, ethylsulfate and phosphate, to balance the cationic charge.

In the context of the above definition, the hydrophobic moiety (i.e., the $C_{12}$–$C_{22}$ aliphatic, $C_{10}$–$C_{16}$ alkyl phenol or alkylbenzyl radical) in the organic radical $R_1$ or $R_2$ may be directly attached to the quaternary nitrogen atom or may be indirectly attached thereto through an amide, ester, alkoxy, ether, or like grouping.

The quaternary ammonium compounds useful herein include both water-soluble compounds and substantially water-insoluble compounds which are dispersible in water. For example, imidazolinium compounds of the structure

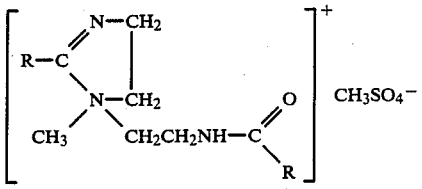

wherein R is a $C_{16}$ to $C_{22}$ alkyl group, possess appreciable water solubility, but can be utilized in the present invention.

The quaternary ammonium softener compounds used in this invention can be prepared in various ways well-known in the art and many such materials are commercially available. The quaternaries are often made from alkyl halide mixtures corresponding to the mixed alkyl chain lengths in fatty acids. For example, the ditallowalkyl quaternaries are made from alkyl halides having mixed $C_{14}$–$C_{18}$ chain lengths. Such mixed di-long chain quaternaries are useful herein and are preferred from a cost standpoint.

The anionic group which can be the counter-ion in the quaternary compounds useful herein is typically a halide (e.g., chloride or bromide), nitrate, bisulfate, ethylsulfate, or methylsulfate. The methylsulfate and chloride ions are the preferred counter-ions from an availability standpoint; while the methylsulfate anion is most preferred because of its minimization of corrosive effects on the automatic clothes dryers in which it is used.

The following are representative examples of quaternary ammonium softening compounds suitable for use in the present invention. All the quaternary ammonium compounds listed can be included in the present invention, but the compilation of suitable quaternary compounds hereinafter is only by way of example and is not intended to be limiting of such compounds. Dioctadecyldimethylammonium methylsulfate is an especially preferred fabric softening compound for use herein, by virtue of its high antistatic, as well as fabric softening activity; ditallowalkyldimethylammonium methylsulfate is equally preferred because of its ready availability and its good antistatic activity; other useful di-long chain quaternary compounds are dicetyldimethylammonium chloride, didocosyldimethylammonium chloride, didodecyldimethylammonium chloride, ditallowalkyldimethylammonium bromide, dioleoyldimethylammonium methylsulfate, ditallowalkyldiethylammonium chloride, ditallowalkyldipropylammonium bromide, ditallowalkyldibutylammonium fluoride, cetyldecylmethylethylammonium chloride, bis-[ditallowalkyldimethylammonium] bisulfate, tris-[ditallowalkyldimethylammonium] phosphate, 1-methyl-1-tallowamidoethyl-2-tallowimidazolinium methylsulfate, and the like. Particularly preferred quaternary ammonium fabric softening compounds are ditallowkyldimethylammonium chloride and ditallowalkyldimethylammonium methylsulfate. The fabric softener core of the particles of the invention comprises from about 70% to about 97% and most preferably about 85% to about 97% of the particle. All percentages herein are "by weight" unless otherwise indicated.

The core composition can consist entirely of cationic fabric softeners, and will generally comprise at least 10%, usually 10% to 50% cationic fabric softener. Optionally, and preferably, the core can contain additional materials such as perfume, auxiliary fabric softening agents (e.g., smectite clay, fatty alcohols and fatty amine, such as ditallowmethyl amine or 1-tallowamidoethyl-2-tallowimidazoline), soil release agents, fabric brighteners, etc. Additional disclosure of materials which can be applied to fabrics along with cationic fabric softening agents in a laundry dryer and, therefore, can be part of the core composition of the particles herein, are disclosed in U.S. Pat. Nos. 4,073,996, Bedenk et al., issued Feb. 14, 1978; 4,237,155, Kardouche, issued Dec. 2, 1980; and 4,421,792, Rudy et al., issued Dec. 20, 1983, all incorporated herein by reference. Preferred additional materials are the encapsulated fabric conditioning perfume microcapsules of U.S. Pat. No. 4,234,627, Schilling, issued Nov. 18, 1980, and British Pat. No. 1,549,432, both of which are incorporated herein by reference. A particularly preferred process for preparing such capsules is disclosed in U.S. Pat. No. 3,697,437, Fogle et al., issued Oct. 10, 1972, incorporated herein by reference. Particle sizes of from about 100 to about 200 microns are preferred.

The coating materials are substantially water-insoluble materials, typically (but not necessarily) selected from waxy materials such as paraffinic waxes, microcrystalline waxes, animal waxes, vegetable waxes, saturated fatty acids and fatty alcohols having from 12 to 40 carbon atoms in their alkyl chain, and fatty esters such as fatty acid triglycerides, fatty acid esters of sorbitan and fatty acid esters of fatty alcohols, or from substantially water-insoluble polymers. Typical specific suitable waxy coating materials include lauric, myristic, palmitic, stearic, arachidic and behenic acids, stearyl and behenyl alcohol, microcrystalline wax, beeswax, spermaceti wax, candelilla wax, sorbitan tristearate, sorbitan tetralaurate, tripalmitin, trimyristin and octacosane. A preferred waxy material is stearyl alcohol.

Examples of water-insoluble polymeric materials which may be used for the coating of the particles herein are [cellulose ethers such as ethyl, propyl or butyl cellulose; cellulose esters such as cellulose acetate, propionate, butyrate or acetate-butyrate]; ureaformaldehyde resins, polyvinyl chloride, polyvinylidene chloride, polyethylene, polypropylene, polyacrylates, polymethacrylates, polymethyl-methacrylates and nylon. Such materials and their equivalents are described in greater detail in any conventional handbook of synthetic organic plastics, for example, in *Modern Plastics Encyclopaedia Volume*, Vol. 62, No. 10A (for 1985–1986) at pages 768–787, published by McGraw-Hill, New York, N.Y. (October 1985), incorporated herein by reference. A preferred polymeric material is ethyl cellulose. The polymeric coating materials can be plasticized with known plasticizing agents such as phthalate, adipate and sebacate esters, polyols (e.g., ethylene glycol), tricresyl phosphate, castor oil and camphor.

The coating surrounds the cationic fabric softener core and is present in an amount of from about 3% to about 30%, preferably from about 3% to about 15% by weight of the particle.

The coating material can comprise a mixture of waxy coating materials and polymeric coating materials. In such mixtures the waxy coating material will typically comprise from about 70% to about 90% of the mixture and the polymeric material about 30% to about 10%.

Typically, the coating material will have a hardness which corresponds to a needle penetration value of about 0.6 mm or less, and preferably less than about 0.1 mm, as measured by ASTM Test D-1321, modified by using a 100 g weight instead of a 50 g weight. The test is preformed at 25°-27° C. In the case of polymeric coating materials, sample preparation is accomplished by dissolving the polymer in a volatile solvent and then evaporating the solvent after the polymer solution has been placed in the test container. For waxy coating materials, sample preparation is done by melting the sample and then solidifying it in the test container in the manner set forth in the ASTM method.

Penetration values of a number of suitable coating materials are shown in the following table.

TABLE 1

Penetration Values of Representative Coating Materials

| Material | Penetraton in mm |
|---|---|
| Stearyl alcohol | 0.57 |
| Ethyl cellulose | 0.09 |
| Cellulose acetate | 0.00 |
| Ethyl cellulose + 10% dibutyl sebacate | 0.00 |
| 70% Stearyl alcohol + 30% $C_{30}$ alcohol | 0.32 |
| 90% Stearyl alcohol + 10% Elvax-4310[1] | 0.12 |
| 90% Stearyl alcohol + 10% BE-Square-195[2] | 0.40 |

[1]Terpolymer of ethylene, vinyl acetate and acid from DuPont
[2]Microcrystalline wax from Petrolite, Speciality Polymers Group The function of the coating which surrounds the fabric softener is to prevent the softener from becoming dissolved and/or dispersed in the wash water when the particles are present during the wash step of a laundry process, and thereby prevent interaction between the fabric softener and the detergent. During the washing and rinsing of the fabrics, a substantial amount of the particles adhere to, or become entrapped within folds of the fabrics. When the fabrics are dried in a heated automatic clothes dryer (typically at temperatures of about 65° to 85° C.), the coating and the fabric softener core composition melt, thereby permitting the softener to spread throughout the fabric load and soften the fabrics.

If the particles are incorporated into a granular detergent composition, it is preferred that the particle size of the softener particles be similar to the particle size of the detergent granule in order to minimize segregation. This will typically be in the range of from about 500 to about 1000 microns. Softener particles which are smaller in size than the detergent granules can be agglomerated to form larger particles to match the particle size of the detergent granules into which they will be incorporated. The agglomeration can be accomplished by using water-soluble or dispersible materials such as polyvinyl alcohol, sodium carboxymethyl cellulose, gelatin and polyoxyethylene waxes. The agglomerates disintegrate when the detergent composition is added to water. Methods and agglomerating agents for agglomeration of fabric softener particles are described in U.S. Pat. No. 4,141,841, McDanald, issued Feb. 27, 1979, incorporated by reference herein.

B. Preparation of Particles

In preparing the softener particles of the invention, the solid fabric softener composition which is to be the core of the particles is formed into particles having a size of from about 4.5 to about 1100 microns. This can be accomplished, for example, by milling the solid softener composition or by melting the composition and spraying it through appropriate sized nozzles into an atmosphere having a temperature below the melting point of the softener, thereby forming the softener composition into solid particles.

The particles of softener composition can then be coated with coating material which is either melted or dissolved in a volatile solvent. The coating is done at a temperature which is below the melting point of the softener composition, and the coated particles are then cooled (or the solvent is evaporated) to solidify the coating. The coating is typically applied in a fluidized bed type apparatus. A suitable type of apparatus is that described in U.S. Pat. No. 3,196,827, Wurster et al., issued July 27, 1965, incorporated by reference herein. In this apparatus, solid softener core particles are suspended on an air stream which carries them in a smooth cyclic flow past the coating nozzle, which sprays them with fluid coating material. Air atomizes and expels the coating fluid through the coating nozzle. The atomized coating fluid covers the surfaces of the core particles. The coated particles are lifted on the air stream and the fluid coating solidifies on the surface of the particles as the air stream lifts them away from the nozzle. The particles then settle out of the air stream and begin another cycle which takes them past the nozzle again. The process is repeated until the desired amount of coating has been deposited on the particles. The amount of coating applied to the softener core particles is typically from about 3% to about 30%, preferably about 3% to about 15% by weight of total particle (i.e., core plus coating).

Alternatively, other types of encapsulating processes such as described in an article by Nack entitled "Microencapsulation Techniques, Applications and Problems," J. Soc. Cos. Chem., Vol. 21, Pages 85-98 (Feb. 4, 1970), incorporated herein by reference, can be used. When perfume microcapsules are incorporated, the processes disclosed in U.S. Pat. No. 4,234,627, supra, incorporated herein by reference, can be used.

If it is desired to aggomerate the softener particles, this can be accomplished in the following manner. The softener particles are fed to a highly efficient mixer (e.g., Schugi Flexomix Model 160,335 or 400 from Schugi Process Engineers U.S.A., 41-T Tamarack Circle, Skillman, N.J. 08558), or a pan agglomerator. Aqueous solution or dispersion of agglomerating agent is sprayed onto the moving particles causing them to stick to each other. The water is evaporated and the dried agglomerated particles are sized by sieving. Suitable agglomerating agents include dextrin starches, Pluronic Polyols (copolymers of ethylene oxide and/or propylene oxide with either ethylene glycol or propylene glycol) and hydratable salts such as sodium tripolyphosphate or sodium sulfate.

The type of apparatus described in U.S. Pat. No. 3,196,827 (Wurster et al.), cited supra, can also be used for agglomerating particles.

C. Detergent Compositions

The particles of the present invention are preferably formulated into detergent compositions. Such compositions typically comprise detersive surfactants and detergency builders and, optionally, additional ingredients such as bleaches, enzymes, fabric brighteners and the like. The particles are present in the detergent composition at a level sufficient to provide from about 0.5% to about 10%, and preferably from about 1% to about 5% of quaternary ammonium fabric softener in the detergent composition. The remainder of the detergent composition will comprise from about 1% to about 50%, preferably from about 10% to about 25% detersive surfactant, and from about 15% to about 60%, preferably from about 20% to about 45% of a detergency builder, and, if desired, other optional laundry detergent components.

1. The Surfactant

Surfactants useful in the detergent compositions herein include well-known synthetic anionic, nonionic, amphoteric and zwitterionic surfactants. Typical of these are the alky benzene sulfonates, alkyl- and alkylether sulfates, paraffin sulfonates, olefin sulfonates, alkoxylated (especially ethoxylated) alcohols and alkyl phenols, amine oxides, alpha-sulfonates of fatty acids and of fatty acid esters, alkyl betaines, and the like, which are well known from the detergency art. In general, such detersive surfactants contain an alkyl group in the $C_9$–$C_{18}$ range. The anionic detersive surfactants can be used in the form of their sodium, potassium or triethanolammonium salts; the nonionics generally contain from about 5 to about 17 ethylene oxide groups. $C_{11}$–$C_{16}$ alkyl benzene sulfonates, $C_{12}$–$C_{18}$ paraffin-sulfonates and alkyl sulfates are especially preferred in the compositions of the present type.

A detailed listing of suitable surfactants for the detergent compositions herein can be found in U.S. Pat. No. 3,936,537, Baskerville, issued Feb. 3, 1976, incorporated by reference herein. Commercial sources of such surfactants can be found in McCutcheon's EMULSIFIERS AND DETERGENTS, North American Edition, 1984, McCutcheon Division, MC Publishing Company, also incorporated herein be reference.

2. Detergency Builders

Useful detergency builders for the detergent compositions herein include any of the conventional inorganic and organic water-soluble builder salts, as well as various water-insoluble and so-called "seeded" builders.

Nonlimiting examples of suitable water-soluble, inorganic alkaline detergent builder salts include the alkali metal carbonates, borates, phosphates, polyphosphates, tripolyphosphates, bicarbonates, silicates, and sulfates. Specific examples of such salts include the sodium and potassium tetraborates, bicarbonates, carbonates, tripolyphosphates, pyrophosphates, and hexametaphosphates.

Examples of suitable organic alkaline detergency builder salts are: (1) water-soluble amino polyacetates, e.g., sodium and potassium ethylenediaminetetraacetates, nitrilotriacetates, and N-(2-hydroxyethyl)nitrilodiacetates; (2) water-soluble salts of phytic acid, e.g., sodium and potassium phytates; (3) water-soluble polyphosphonates, including sodium, potassium and lithium salts of ethene-1-hydroxy-1,1-diphosphonic acid, sodium, potassium, and lithium salts of methylenediphosphonic acid and the like.

Seeded builders include such materials as sodium carbonate or sodium silicate, seeded with calcium carbonate or barium sulfate.

A detailed listing of suitable detergency builders can be found in U.S. Pat. No. 3,936,537, supra, incorporated herein by reference.

3. Optional Detergent Ingredients

Optional detergent composition components include enzymes (e.g., proteases and amylases), halogen bleaches (e.g., sodium and potassium dichloroisocyanurates), peroxyacid bleaches (e.g., diperoxydodecane-1,12-dioic acid), inorganic percompound bleaches (e.g., sodium perborate), activators for perborate (e.g., tetraacetylethylenediamine and sodium nonanoyloxybenzene sulfonate), soil release agents (e.g., methylcellulose) soil suspending agents (e.g., sodium carboxymethylcellulose) and fabric brighteners.

C. Pouched Compositions

When fabric softener particles of the invention are added to the wash step of a laundering process, it is inevitable that some of the particles will not adhere to or become trapped in the folds of the fabrics and will, therefore, be lost in the discarded wash solution or rinse water. In order to avoid such loss, the particles can be added to the wash solution in a sealed, porous water-insoluble pouch such as the type described in U.S. Pat. No. 4,223,029, Mahler et al., issued Sept. 16, 1980, incorporated by reference herein. Detergent granules can be included in the pouch with the softener particles. When the pouch is placed in water in the wash step of the laundering process, the detergent dissolves, but the softener particles remain in the pouch. The pouch remains with the fabrics through the wash and rinse. When the pouch is tumbled with the fabrics in the dryer, the softener particles release the softener, which melts onto the pouch material and is transferred from the pouch material to the fabrics as the pouch comes into contact with the fabrics during the drying cycle. Preferred pouch structures are multi-pouch porous sheet structures such as described in U.S. patent application Ser. No. 675,804, Bedenk et al., filed Nov. 28, 1984, now U.S. Pat. No. 4,638,907, Bedenk/Harden, issued Jan. 27, 1987; and U.S. Pat. No. 4,259,383, Eggensperger et al., issued Mar. 31, 1981, both incorporated herein by reference. In a single pouch structure, the particles tend to collect in a relatively small area of the structure, whereas in a multi-pouch sheet structure the softener particles are distributed over a larger area of the structure thereby facilitating more even transfer of softener to fabrics in the dryer.

Suitable pouch materials include, paper, nonwoven synthetics such as spunbonded and wet laid polyester, and porous formed film plastic sheet material.

In a further improvement of the multi-pouch type of structure, the individual pouches have a water-insoluble baffling means which provides some standoff between the interior major surfaces of the pouches while the multi-pouch sheet is being tumbled in the clothes dryer. The standoff prevents the interior major surfaces of each pouch from coming into intimate contact with each other during the drying cycle, thereby reducing the tendency of the molten softener to be squeezed out of the pouch during the drying cycle, which can cause fabric staining. It is preferred that the molten softener be permitted to gradually wick through the substrate and thereby gradually transfer to the tumbling fabrics. The baffling can be produced, for example, by printing a cross hatched glue pattern on one of the interior surfaces of the pouch material or by including a layer of polymeric net material between the interior major surfaces of the pouches.

The invention will be illustrated by the following examples.

EXAMPLE I

Fabric softener core particles are prepared according to the following formula:

| Ingredient | Wt. % |
|---|---|
| Ditallowdimethylammonium methylsulfate (DTDMAMS) | 42.4 |
| Sorbitan monostearate | 21.3 |
| Cetyl alcohol | 21.3 |
| Bentonite clay | 12.0 |

-continued

| Ingredient | Wt. % |
|---|---|
| Perfume | 3.0 |
| Total | 100.0 |

The DTDMAMS is heated in a reaction vessel at 71° C. under vacuum (Ca. 710 mm Hg) for 4 hours to remove residual moisture and/or isopropanol. The cetyl alcohol and sorbitan monostearate are then added, and the molten "triblend" is mixed for one hour at about 71° C.

The triblend is transferred into a PVM 40 Ross mixer (Charles Ross & Sons Company, Hauppauge, New York 11788). The temperature of the triblend is then raised to 79° C.–85° C. under vacuum (about 330–430 mm Hg). When the temperature has stabilized in this range, the Ross' anchor and disperser are turned on and the clay is added. The mixture is blended for 5 minutes and then sheared with the Ross' colloid mixer for 20 minutes. The perfume is then added and the mixture is blended for 5 minutes with the anchor, disperser and colloid mill still on. The softener composition is then poured into trays and cooled overnight at about 4° C.

The solid softener core composition is then converted to particles by milling in a Fitzmill, Model DA506 (The Fitzpatrick Company, Elmhurst, Ill. 60126) at 4740 rpm's through a 4 mesh screen. The particles are then sized through 12 on 30 (U.S. Standard screens, 1.7–0.6 mm particle size).

The particles are then coated with a hot melt of fatty alcohol-based coating. The coating is a mixture of 90% stearyl alcohol and 10% Elvax-4310, a terpolymer of ethylene, vinyl acetate and acid from E. I. du Pont de Nemours & Co., Polymer Products Dept., 1007 Market St., Wilmington, Del. 19898. The coating is applied in an 18 Inch Wurster coater (Coating Place, Inc., P.O. Box 248, Verona, Wis. 53593). A detailed description of this type of equipment can be found in U.S. Pat. No. 3,196,827, supra, incorporated by reference herein.

Briefly, the Wurster Coater consists of an apparatus that is capable of suspending the softener core particles on a rapidly moving warm air stream. Encapsulation is accomplished by passing the softener particles through a zone of finely atomized droplets of coating. As the particles move up and away from the coating nozzle, the coating begins to solidify as the particles cool. When the particles can no longer be fluidized by the air stream, they move down in the opposite direction of the fluidizing air. The coated particles then reenter the coating zone and are recycled until the desired amount of coating is applied. The coating cycle takes place within a single chamber which preferably has a partition to separate the particles moving up through the coating zone from those moving down through the cooling zone.

The following conditions are used to apply a hot melt coating:

| | |
|---|---|
| Stearyl Alcohol/Elvax Temperature | 79° C. |
| Fluidizing Air | 15.8 Cu.M/min. at 40.5° C. |
| Atomizing Air Volume | 0.25 Cu.M/min. |
| Atomizing Air Rate | 4218 g/sq.cm. |
| Inlet Air Temperature | 20° C.–38° C. |
| Outlet Air Temperature | 20° C.–38° C. |
| Pump Rate | 0.2 Kg/min. |
| Nozzle Size | CPI-18-A74* |

-continued

| | |
|---|---|
| Partition Size | 216 mm × 267 mm |
| Partition Gap | 19 mm |
| Run Time | 22 min. |

*Available from Coating Place, Inc.

The amount of fatty alcohol coating applied to the softener particles is about 15% by weight of the total coated particle. After the coating process is complete the particles are resized through 12 on 20 mesh and are then ready for use "as is" or for blending into detergent granules.

EXAMPLE II

Softener core particles prepared as in Example I are coated with ethyl cellulose based coating instead of fatty alcohol. The coating is applied by spraying a 10% solids solution in methanol of 9 parts ethyl cellulose and 1 part dibutyl sebacate. The coating is applied in an 18 Inch Wurster coater as described in Example I. The ethyl cellulose used is Ethocel Std. 4, (Dow Chemical Co., Midland, Michigan 48640) which has an Ubbelhode viscosity of 3.0–5.5, measured at 25° C. as a 5% solution in 80% toluene/20% ethanol.

The following conditions are used to apply a solvent based coating:

| | |
|---|---|
| Fluidizing Air | 15.8 Cu.M/min. at 40.5° C. |
| Atomizing Air Volume | 0.37 Cu.M/min. |
| Atomizing Air Rate | 5624 g/sq.cm. |
| Inlet Air Temperature | 38° C.–43° C. |
| Outlet Air Temperature | 30° C.–32° C. |
| Pump Rate | 0.2 Kg/min. |
| Nozzle Size | CPI-18-A74* |
| Partition Size | 216 mm × 267 mm |
| Partition Gap | 19 mm |
| Run Time | 120 min. |

*Available from Coating Place, Inc.

The amount of ethyl cellulose/dibutyl sebacate solids coated onto the particles is about 5% by weight of the total coated particle weight. When the coating is completed, the softener particles are resized through 12 on 30 Mesh U.S. Standard screens and are then ready for use "as is" or for blending into detergent granules.

EXAMPLE III

A fabric softener core particle containing perfume capsules is prepared according to the following formula:

| Ingredient | Wt. % |
|---|---|
| Perfume | 89.20 |
| Gelatin 275 Bloom | 8.80 |
| Glutaraldehyde | 1.12 |
| Polyphosphate | 0.88 |
| Total | 100.00 |

The perfume capsules are prepared using a complex coacervation process as described in U.S. Pat. No. 3,697,437, supra. Briefly, the process is as follows.

To a vessel equipped for stirring and heating, the following components are each preheated to 52° C. and combined: 1000 mls of deionized water, 1000 mls of a 10% by weight solution of gelatin in deionized water (Kind & Knox Type A gelatin, 275 Bloom) and 1000 mls of a water-insoluble perfume. The solution is then emulsified via agitation at 52° C. The agitation speed is adjusted such that the mean particle size of the droplets is between 100 and 200 microns.

When the system is stabilized, 200 mls of a 5% by weight polyphosphate (Calgon Conditioner 206, a polyphosphate having a minimum of 67% by weight $P_2O_5$ and an empirical formula of $Na_{16}P_{24}O_{43}$) preheated to 52° C. is added. At this point in the process the pH of the emulsion should be between 5.4 and 5.6. The pH is then lowered to 4.3 using glacial acetic acid to initiate the coacervation reaction.

The solution is then cooled to ambient over a 2–3 hour period with constant stirring. The solution is then cooled further to 5°–10° C. before adding 50 mls of 25% glutaraldehyde solution to chemically harden the capsule wall. The glutaraldehyde is allowed to react for at least 4 hrs. while the solution temperature is slowly raised to ambient.

When the solution temperature returns to ambient, the reaction should be complete. Before filtering the solution to isolate the perfume capsules, 20 gms of Syloid (Syloid Silicas, ID/Aerogel Grade 244, W. R. Grace) is added as a filtration aid. The filter cake of capsules is then washed with deionized water. The filter cake is then broken up and allowed to air dry, e.g., in trays, in a fluid bed, an air conveyor with heating. Additional Syloid (20 gms) can be added to act as a drying and/or handling agent.

The fabric softener core particles are prepared according to the following formula:

| Ingredient | Wt. % |
|---|---|
| Ditallowdimethylammonium methylsulfate (DTDMAMS) | 42.4 |
| Sorbitan monostearate | 21.3 |
| Cetyl alcohol | 21.3 |
| Bentonite clay | 12.0 |
| Perfume | 3.0 |
| Total | 100.0 |

The DTDMAMS is heated in a reaction vessel at 71° C. under vacuum (Ca. 710 mm Hg) for 4 hours to remove residual moisture and/or isopropanol. The cetyl alcohol and sorbitan monostearate are then added, and the molten "triblend" is mixed for one hour at about 71° C.

The triblend is transferred into a PVM 40 Ross mixer (Charles Ross & Sons Company, Hauppauge, N.Y. 11788). The temperature of the triblend is then raised to 79° C.–85° C. under vacuum (about 330–430 mm Hg). When the temperature has stabilized in this range, the Ross' anchor and disperser are turned on and the clay is added. The mixture is blended for 5 minutes and then sheared with the Ross' colloid mixer for 20 minutes. The perfume capsules are then added and the mixture is blended for 10 minutes with only the anchor on at its lowest speed. The softener composition is then poured into trays and cooled overnight at about 4° C.

The solid softener core composition is then converted to particles by milling in a Fitzmill, Model DA506 (The Fitzpatrick Company, Elmhurst, Ill. 60126) at 4740 rpm's through a 4 mesh screen. The particles are then sized through 12 on 30 (U.S. Standard screens, 1.7–0.6 mm particle size).

The softener particles are then coated with a 5% level of a blend of 90% Ethocel 10 and 10% Ethocel 45 (Dow Chemical Co., Midland, Michigan 48640). The Ethocel 10 has a Ubbelhhode viscosity between 9–11 and the Ethocel 45 has a viscosity of 41–49, as measured as a 5% solution in 80% toluene and 20% ethanol.

EXAMPLE IV

A granular detergent/softener composition is prepared by mixing 4 parts of the coated softener particles of Example I, II or III with 96 parts of the following granular detergent composition.

| Ingredient | Wt. % |
|---|---|
| Sodium $C_{13}$ linear alkylbenzene sulfonate | 16.5 |
| Sodium $C_{14}$–$C_{15}$ linear fatty alcohol sulfate | 16.5 |
| Sodium sulfate | 23.8 |
| Sodium silicate | 9.2 |
| Polyethylene glycol | 0.9 |
| Polyacrylic acid | 1.3 |
| Sodium tripolyphosphate | 13.7 |
| Sodium carbonate | 4.8 |
| Methyl cellulose | 3.6 |
| Optical brightener | 1.3 |
| Protease enzyme | 1.6 |
| Moisture and miscellaneous | 6.8 |
| Total | 100.0 |

EXAMPLE V

A granular bleach/softener composition is prepared by mixing 4 parts of the coated softener particles of Example I, II or III with 96 parts of the following granular bleach composition.

| Ingredient | Wt. % |
|---|---|
| Diperoxydodecanedioic acid | 24.0 |
| Dodecanedioic acid | 2.9 |
| Sodium $C_{13}$ linear alkylbenzene sulfonate | 5.5 |
| Boric acid | 27.7 |
| Sodium sulfate | 39.7 |
| Miscellaneous | 0.2 |
| Total | 100.0 |

EXAMPLE VI

A laundering article in the form of a multipouch sheet is prepared as follows.

The sheet is comprised of two sheets of Reemay® 2420 spunbonded polyester (DuPont, Wilmington, Del.). In between the sheets is a honeycomb web made from polyethylene. The web has a thickness of approximately 0.04 inch (0.10 cm) and the cells of the web are diamond shaped, having a cross dimension of approximately 0.19 inch (0.48 cm) and a length dimension of approximately 0.63 inch (1.60 cm). The three-layered structure has outer edge dimensions of approximately 4.5 inches×11 inches (11.4 cms×27.9 cms). The structure is laminated together in a pattern so as to form six equal sized pouches, two pouches at each end containing about 14.7 grams each of the bleach/ethyl cellulose coated softener composition of Example V and the four pouches in between containing about 15.5 grams each of the detergent/ethyl cellulose coated softener composition of Example IV.

The article is suitable for washing and softening laundry in a process involving washing and rinsing the fabrics, followed by tumble drying in a heated clothes dryer, wherein the article remains with the laundry throughout the entire process.

EXAMPLE VII

This example is the same as Example VI, except that (1) the softener and detergent levels are, respectively, 2.2 parts and 97.8 parts, (2) the softener and bleach levels are, respectively, 2.6 parts and 97.4 parts; and (3) the multipouched sheet is comprised of a top sheet of a latex bonded, wet laid polyester/wood pulp substrate (James River 5227, James River Corp., Greenville, S.C. and an embossed sheet of Reemay® 2420, a spunbonded polyester (Dupont, Wilmington, Del.). The two sheets are laminated together with an outer edge dimension of approximaely 4.5 inches×11 inches (11.4×27.9 cms) and with a pattern so as to form six equal sized pouches. The two pouches at each end are filled with about 14.7 grams of the bleach/ethyl cellulose coated softener composition of Example V and the four pouches in between are filled with about 15.5 grams of the detergent/ethylcellulose coated softener composition of Example IV.

When a dusty detergent powder is used in a pouched sheet, as set forth above, the porous substrates may not be able to contain the dust adequately. One solution to this problem is to spray the inside of the detergent pouches with a wetting agent selected from suitable, relatively nonvolatile, organic liquids like water, surfactant solutions, propylene or ethylene glycol, light oils, liquid polyethylene glycols, nonionic surfactants, etc., capable of forming and maintaining a tacky surface on the detergent powder particles. Said liquid should not be capable of forming, by itself, a barrier of any type between the substrate and the detergent composition. The portion of the substrate that defines the pouch that contains the detergent powder is sprayed with an effective amount, typically from about 0.01 gram to about 0.2 grams per square inch, preferably from about 0.04 gram to about 0.1 gram per square inch, of said wetting agent. The detergent powder is added to the detergent pouch before the wetting agent evaporates or otherwise disappears. The tacky detergent powder then obstructs, at least partially, the pores of the substrate, and thus minimizes the escape of the very fine detergent powder particles (dust). The porous substrate in this Example is coated with approximately 0.06 gram per square inch of organic liquid (propylene glycol) and, before it dries, the detergent powder is added to the sheet.

The finished article is suitable for washing and softening laundry in a process involving washing and rinsing the fabrics, followed by tumble drying in a heated clothes dryer, wherein the article remains with the laundry throughout the entire process.

What is claimed is:

1. A through-the-wash detergent and fabric softening composition comprising:

(A) from about 1% to about 50% of detersive surfactant;

(B) from about 15% to about 60% of detergency builder;

(C) from about 0.5% to about 10% of detergent-compatible, dryer activated fabric softener composition in particulate form, the said particles comprising:

(a) an inner core of fabric softener composition consisting essentially of at least about 10% of a cationic fabric softener, the said softener composition having a melting point of from about 50° C. to about 80° C. and the remainder of said inner core being materials which can be applied to fabrics along with said cationic fabric softener in a laundry dryer; and (b) a coating surrounding said core, said coating being a substantially water-insoluble material having a melting point above about 35° C. and a penetration value of about 0.6 mm or less as measured by ASTM Test D-1321, modified by using a 100 gram weight, said water-insoluble material being selected from the group consisting of: cellulose ethers, cellulose esters, and mixtures thereof;

the said coating comprising from about 3% to about 30% of said particle, the said inner core comprising from about 97% to about 70% of said particle, and the said particles having a size of from about 5 to about 1,000 microns.

2. The composition of claim 1 wherein the cationic softener in the inner core (a) is of the formula $$[R_1R_2R_3R_4N]^+Y^-$$

wherein one or two of the $R_1$, $R_2$, $R_3$ and $R_4$ groups is an organic radical containing a group selected from $C_{12}$–$C_{22}$ aliphatic radicals having from 10 to 16 carbon atoms in the alkyl chain and alkylbenzyl radicals having from 10 to 16 carbon atoms in the alkyl chain, the remaining groups being selected from $C_1$–$C_4$ alkyl, $C_2$–$C_4$ hydroxyalkyl, and cyclic structures in which the nitrogen atom in the formula forms part of a ring, and wherein $Y^-$ is an anionic radical, and wherein the cationic softener comprises from about 10% to about 50% of the softener composition of the inner core (a), and wherein the coating (b) comprises from about 3% to about 15% of said particle.

3. The composition of claim 2 wherein the coating (b) has a melting point above 50° C.

4. The composition of claim 3 wherein the cationic softener is ditallowdimethylammonium methylsulfate.

5. The composition of claim 4 wherein the coating material comprises ethyl cellulose.

6. The composition of claim 5 wherein the ethyl cellulose is plasticized with dibutyl sebacate.

7. The composition of claim 1 wherein said inner core (a) additionally comprises microcapsules of fabric conditioning compositions that comprise materials that are not cationic fabric softeners.

8. The composition of claim 7 wherein said fabric conditioning compositions comprise at least one perfume material.

9. The composition of claim 8 wherein said perfume is encapsulated in a cross-linked gelatin.

10. The composition of claim 1 wherein said detersive surfactant (A) is present at a level of from about 10% to about 25%; said detergency builder (B) is present at a level of from about 20% to about 45%; and said fabric softener composition in particulate form (C) is present at a level that will give from about 1% to about 5% of quaternary ammonium fabric softener in said detergent composition.

11. The composition of claim 10 wherein the coating material comprises ethyl cellulose.

* * * * *